US005486725A

United States Patent [19]

Keizer et al.

[11] Patent Number: 5,486,725

[45] Date of Patent: Jan. 23, 1996

[54] SECURITY POWER INTERRUPT

[76] Inventors: Daniel J. Keizer, 38 First Avenue, Schumacher, Ontario, Canada, P0N 1G0; Steven A. Lax, 193 Crestwood Road, Toronto, Ontario, Canada, L4J 1A8; Robert K. Muylwyk, 54 Amelia Street, Toronto, Ontario, Canada, M4X 1E1

[21] Appl. No.: 173,046

[22] Filed: Dec. 27, 1993

[51] Int. Cl.[6] ..... H01H 71/24

[52] U.S. Cl. ..... 307/116; 307/40; 307/42; 307/131; 307/139

[58] Field of Search ..... 307/116, 139, 307/141, 131, 40, 42

[56] References Cited

U.S. PATENT DOCUMENTS

| | | | |
|---|---|---|---|
| 1,146,016 | 7/1915 | Oppenheim et al. . | |
| 3,143,067 | 8/1964 | Rorke | 200/43 |
| 3,841,031 | 10/1974 | Walsh . | |
| 4,247,743 | 1/1981 | Hinton et al. | 200/44 |
| 4,323,762 | 4/1982 | Ervin et al. | 219/482 |
| 4,348,696 | 9/1982 | Beier | 358/188 |
| 4,463,228 | 7/1984 | Osika | 200/51 |
| 4,617,472 | 10/1986 | Slavik | 307/10 |
| 4,659,909 | 4/1987 | Knutson | 219/452 |
| 4,782,420 | 11/1988 | Holdgaard-Jensen | 361/58 |
| 4,839,993 | 6/1989 | Masuko et al. . | |
| 5,036,015 | 7/1991 | Sandhu et al. . | |
| 5,071,360 | 12/1991 | Lindow et al. | 439/133 |
| 5,205,082 | 4/1993 | Shendon et al. . | |
| 5,216,843 | 6/1993 | Breivogel et al. . | |
| 5,232,875 | 8/1993 | Tuttle et al. . | |
| 5,234,867 | 8/1993 | Schultz et al. . | |

FOREIGN PATENT DOCUMENTS

| | | | |
|---|---|---|---|
| 84301352 | 10/1984 | European Pat. Off. | G07C 9/00 |
| 85201738 | 4/1987 | European Pat. Off. | G07F 15/00 |
| 88116873 | 4/1990 | European Pat. Off. | A61B 6/00 |
| 4229731A1 | 4/1993 | Germany | H02B 15/00 |
| WO85/03789 | 8/1985 | WIPO | G07C 9/00 |
| WO89/02968 | 4/1989 | WIPO | E05B 49/00 |
| WO93/14350 | 7/1993 | WIPO | F24C 3/12 |
| 94/00706 | 12/1994 | WIPO | G07C 9/00 |

*Primary Examiner*—William M. Shoop, Jr.
*Assistant Examiner*—Albert Paladini
*Attorney, Agent, or Firm*—Mark B. Eisen

[57] ABSTRACT

A security electrical interrupt device for preventing unauthorized usage of an electrical appliance such as an electric stove, while retaining operation of auxiliary electrical equipment such as the lights and an electrical clock. The device comprises a relay controlled by a micro-processor based programmable controller which measures the amount of electrical supply current being drawn by the appliance. A software computer program stored in the micro-controller commands the relay to disconnect the supply power if any person attempts to operate any part of the appliance which draws electrical current exceeding a preset limit while the controller is in the interrupt mode. The micro controller is programmed to enter the interrupt mode by 1) key sequences entered on a small detachable keypad, 2) when a programmed amount of time has elapsed since the last authorized usage, or 3) by removal of the detachable key pad. The micro-controller restores full supply power to the appliance by key sequences entered on the key pad.

12 Claims, 3 Drawing Sheets

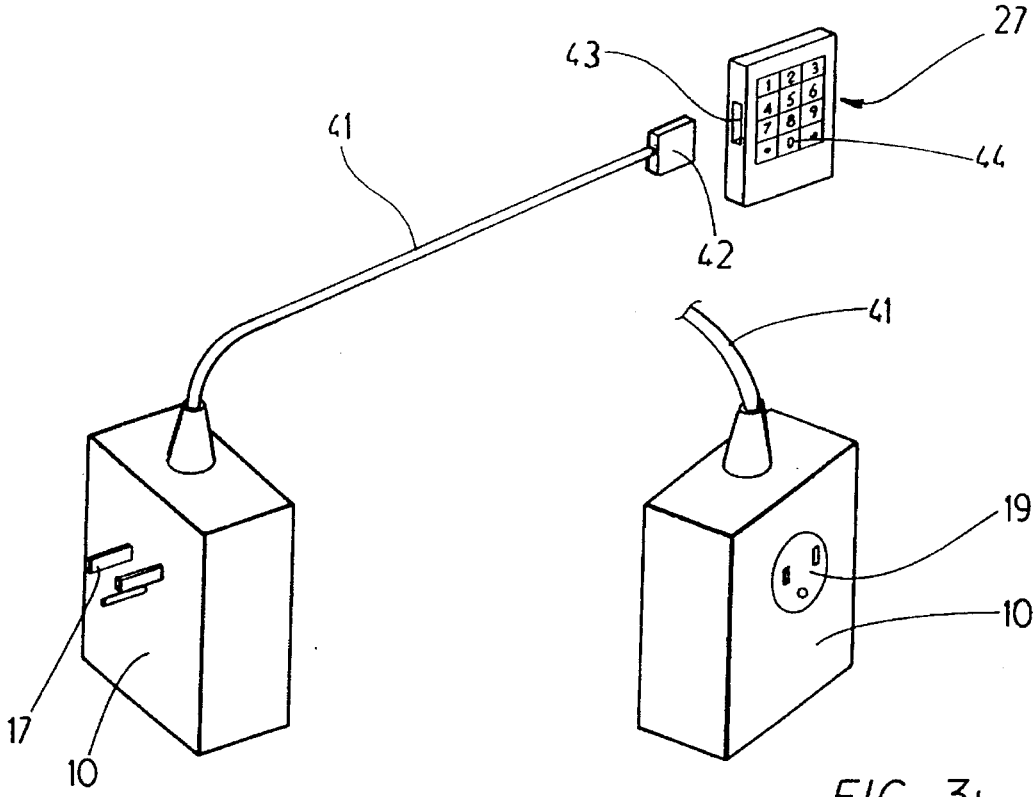
FIG. 3b
FIG. 3a
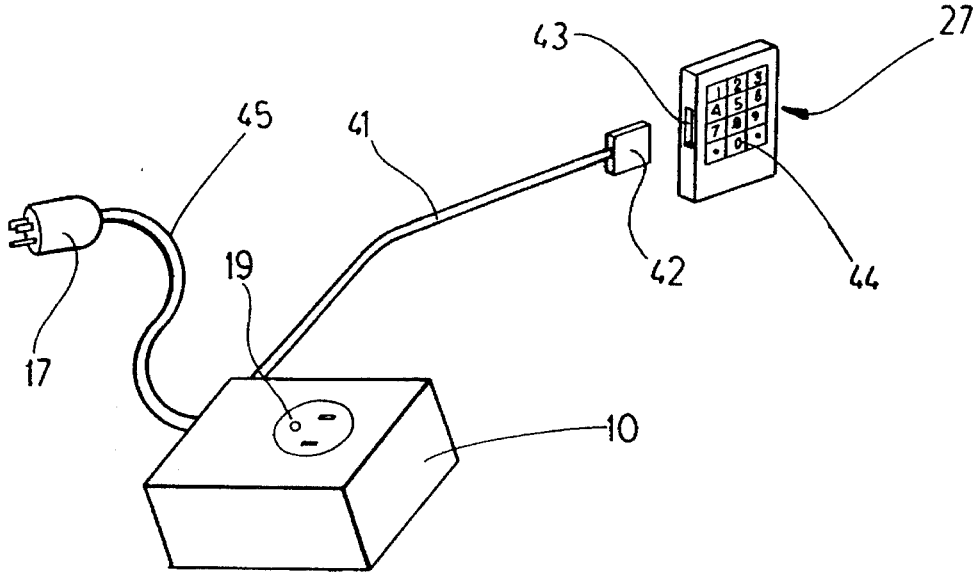
FIG. 4

SECURITY POWER INTERRUPT

The present invention relates to an electrical security power interrupt device, and more particularly to a device that prevents and/or controls the unauthorized use of an electrical appliance by enabling an authorized user to select a mode which will interrupt the supply power to the appliance if a high current-drawing component is activated.

BACKGROUND OF THE INVENTION

Many household electrical appliance can be hazardous if not properly used and monitored. There are many recorded instances of disastrous home fires caused by unauthorized operation of a household appliance such as a stove by children, burglars or vandals, or persons of reduced capacity or faculties such as the elderly. It is thus advantageous to be able to selectively control the use of such appliances.

In the prior art, means have been provided to prevent unauthorized usage of electrical appliances, primarily through key operated electro-mechanical circuit interrupt devices. However, such devices conventionally provide for on-off control only, meaning that the device completely interrupts the flow of electrical power to the appliance while the interrupt or "locked" state, and it connects the appliance to the electrical supply in the operative or "unlocked" state. In the case of, for example, a stove, once the supply power has been cut off auxiliary electrical equipment such as lighting and an electrical clock also ceases to function.

The present invention provides a security power interrupt for an electrical appliance whereby the appliance retains a connection to the power supply while in interrupt or "locked" mode; complete power shutoff only occurs when a preset electrical current is exceeded, thus allowing operation of the appliance's auxiliary electrical equipment while the device is in the interrupt mode.

In a preferred embodiment, the security power interrupt device of the present invention is controlled by a detachable electronic keypad, whereby a predetermined sequence of key strokes interrupts or restores power to the appliance. Power is supplied to the keypad by a DC current transformed from the wall outlet into which the device is plugged, and the appliance is in turn plugged into the main body of the device. Also in the preferred embodiment, the keypad is connected by a wire remotely from the main body of the device, allowing flexibility in the placement of the keypad. For this purpose the keypad may be provided with a magnet, for detachably affixing the keypad to the metallic housing of the appliance.

Further, the keypad is detachable from the device, thus preventing the interrupt device from being switched out of the interrupt mode and thereby preventing attempts to break the coded key sequence and restore normal supply power to the appliance. The device automatically switches to the interrupt mode when the correct numerical sequence is entered on the keypad, when the keypad is disconnected from the device or after a preset time interval has passed since the last authorized use of the appliance.

SUMMARY OF THE INVENTION

The present invention thus provides a device for interrupting power to an electrical appliance, comprising means for connecting the device to an electrical power supply, means for supplying electrical power to the appliance, means for interrupting power to the appliance in an interrupt mode responsive to activation of a portion of the appliance which draws electrical current exceeding a preset limit, and means for switching the device between the interrupt mode and an operational mode in which the appliance is fully operational, whereby when the device is in the interrupt mode power is supplied to the appliance until a portion of the appliance which draws an electrical current greater than the preset limit is activated thereby interrupting power to the appliance.

BRIEF DESCRIPTION OF DRAWINGS

In drawings that illustrate by way of example only a preferred embodiment of the invention.

FIG. 3*a* is a perspective view of the device of the present invention configured for a 120 V electrical appliance, showing the main body from the rear;

FIG. 3*b* is a perspective view of the main body of FIG. 3*a* from the front;

FIG. 4 is a perspective view of an alternate embodiment of the present invention having an extension cord;

DETAILED DESCRIPTION OF THE INVENTION

Figure 1:
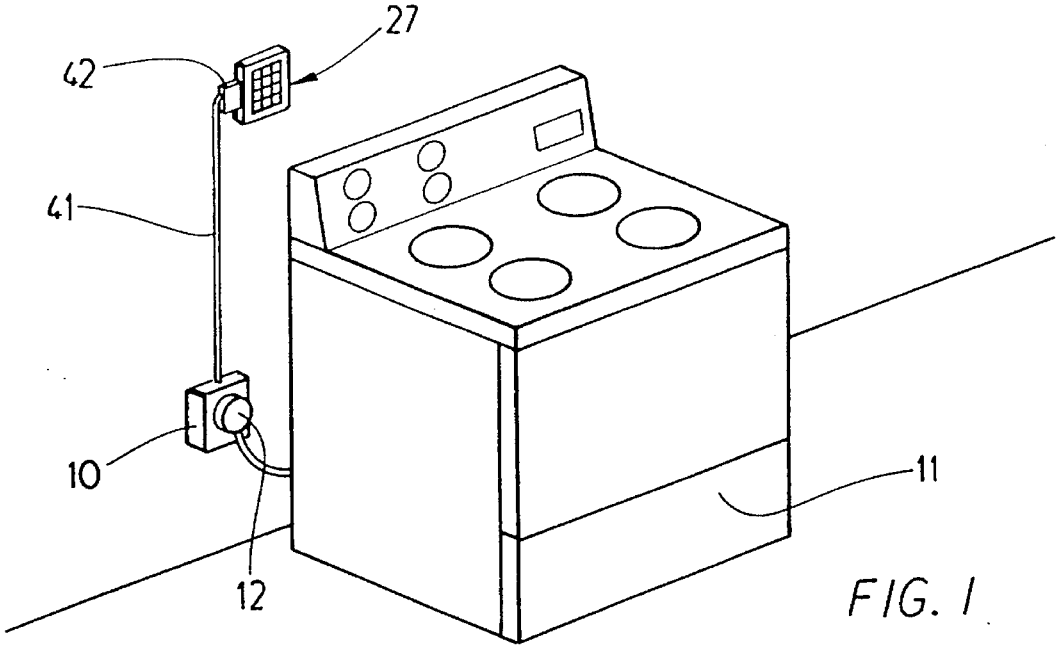
FIG. 1 is a schematic perspective view illustrating the embodiment of FIG. 1 connected to a 220 V electric stove, with the detachable key pad mounted on a wall.
Figure 2:
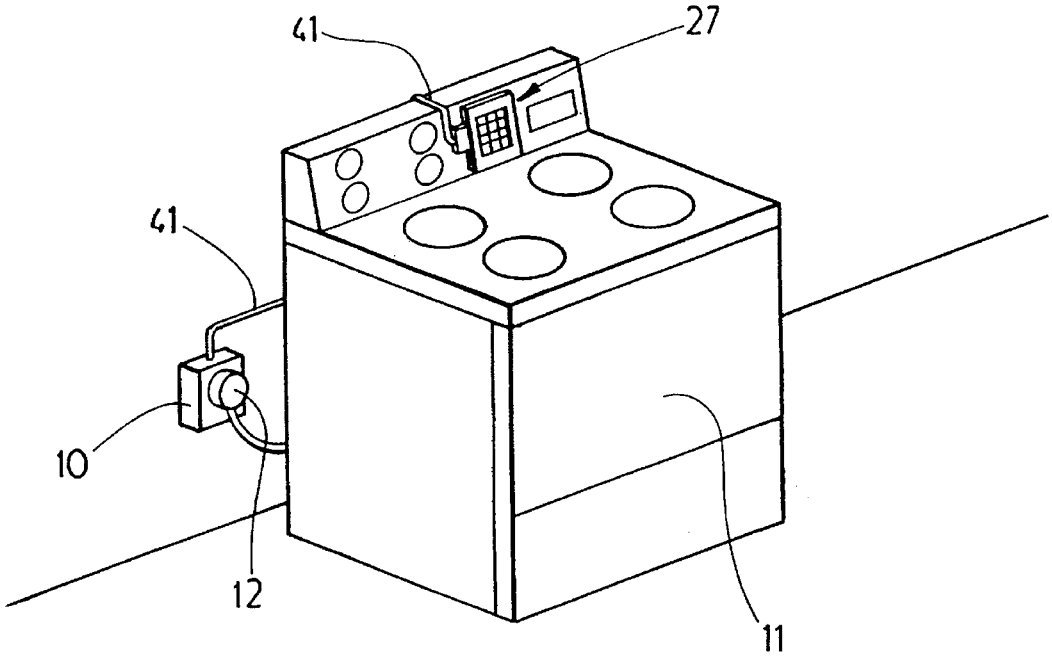
FIG. 2 is a schematic perspective view illustrating the embodiment of FIG. 1 connected to an electric stove, with the detachable key pad magnetically mounted on the stove.

As shown in FIGS. 1 and 2, the electrical plug 12 of an appliance 11, in the embodiment illustrated a stove operating on a 220 V household mains power supply, is connected to a female socket 19 in the main body 10 of the device for preventing unauthorized usage of an electrical appliance. The device is in turn plugged into a 220 V wall receptacle 14.

Figure 5:
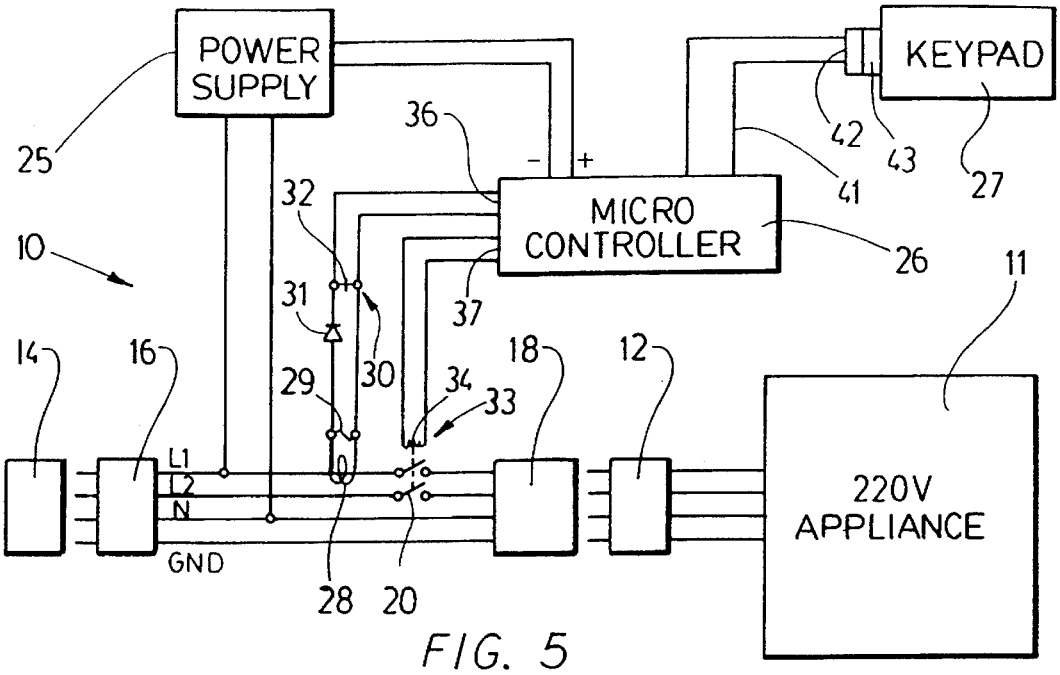
FIG. 5 is a schematic block diagram of the invention, configured to prevent unauthorized usage of a 220 V appliance, such as an electrical stove.

The electrical circuitry, illustrated in FIG. 5 for a 220 V configuration of the device, is contained within the main body 10. The device interrupts the current from the power supply to the appliance 11 when the contacts 20 of the relay 33 are opened; the current from power supply is transferred to the appliance 11 when contacts 20 of he relay 33 are closed.

Figure 6:
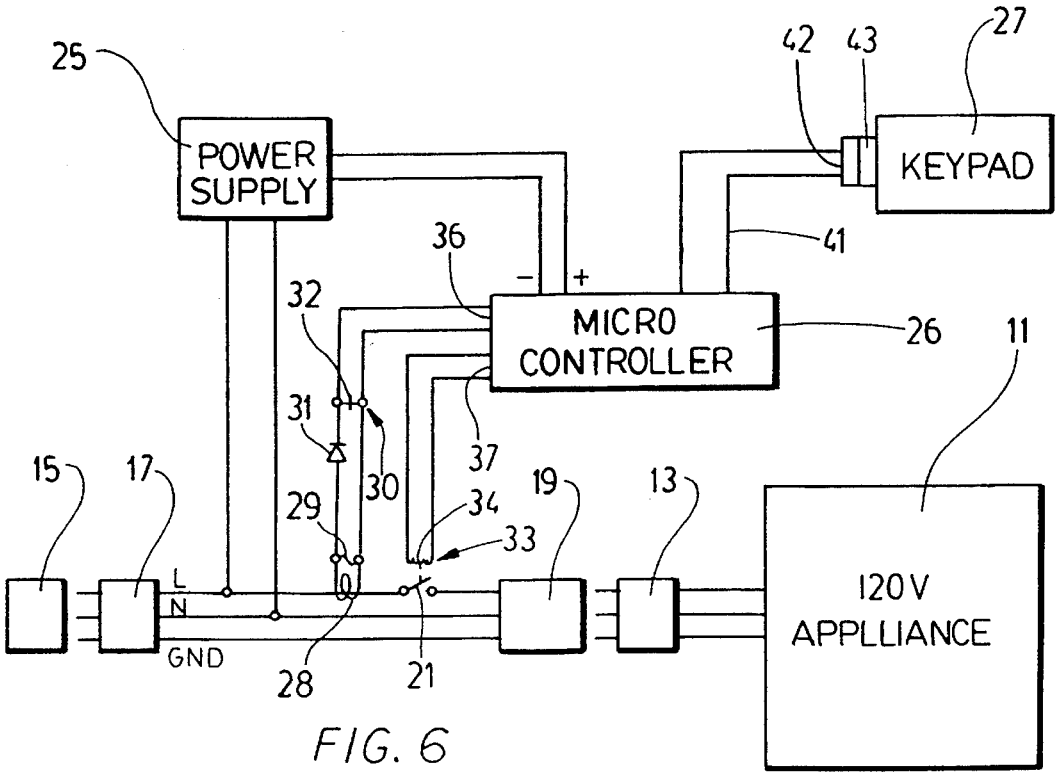
FIG. 6 is a schematic block diagram of the invention, configured to prevent unauthorized usage of a 120 V appliance, such as an electric range or space heater.

In the case of a 220 Volt appliance, relay contacts 20 are configured in dual-pole single-throw form, so that both voltage-carrying lines L1 and L2 are switched by the relay 33. In the case of a 120 Volt appliance, as shown in FIG. 6, the contacts 21 of the relay 33 are configured in single-pole single-throw form, so that the voltage-carrying line L is switched by the relay 33. In either configuration, the relay contacts 20 or 21 must have the appropriate electrical rating for the appliance 11.

The device for preventing unauthorized usage of an electrical appliance further comprises a DC-power supply 25, which generates the direct current (DC) voltages required by the micro-controller 26; a detachable key pad 27; a current transformer 28 with current transformer shunt 29; a rectifier circuit 30, conventionally comprised of rectifier diode 31 and filter capacitor 32; and the relay 33, comprised of relay coil 34 and contact sets 20 (for the 220 V embodiment of FIG. 5) or 21 (for the 120 V embodiment of FIG. 6).

FIG. 3 shows the preferred embodiment of the present invention for preventing unauthorized use of a 120 V appliance, such as an electric heater or hot plate, by way of example. The main body 10 is in the form of a closed box, directly inserted between wall socket 15 and the appliance plug 13. Thus plug 17 is inserted in wall socket 15, with appliance plug 13 inserted into socket 19 in the main body 10. Key pad cable 41, which implements the required electrical connections between the key pad 27 and the circuitry in the main body 10 of the device, has a cable connector 42 which can be connected to mating receptacle 43. Key pad 27 has a number of entry keys 44, as is conventional.

Key pad 27 is thus detachable from the device. For wallmount applications, as shown in FIG. 1, key pad 27 can be mounted to the wall with detachable adhesive material, such as "Velcro" (trademark), or with more permanent securing means. For appliance mounting applications, as illustrated in FIG. 2, key pad 27 is removably affixed to the metal body of the appliance 11 magnetically, by means of a magnet (not shown) mounted on the rear of the key pad 27.

FIG. 4 shows an alternate embodiment of the present invention, in which the male plug 17 is extended from the main body 10 by means of a power cord 45, similar to an electrical extension cord.

The embodiments of both FIGS. 3 and 4 are adapted for use with existing appliances, in that the appliance 11 itself does not require any alteration to utilize the device. In a third embodiment (not shown) the invention may be integrated in the electrical wiring of the appliance 11 by the manufacturer, prior to sale of the appliance to the consumer.

The micro-controller 26, illustrated in FIGS. 5 and 6, is of conventional design, having associated with it one analog input channel 36, on Which it can acquire an analog input signal which is roughly proportional to the amount of electrical current drawn by the appliance 11; one digital output channel 37, through which the micro-controller 26 can control the flow of current from the mains power supply to the appliance 11 by energizing or de-energizing relay coil 34; and a key pad input for connection of detachable key pad 27.

Micro-controller 26 is electrically programmed with a software program performing the tasks which are necessary to implement the functions of the device. The software program is a conventional multi-tasking program, with each task implementing a distinct function. As a minimum, the software program performs the following tasks:

1) The first task is a key pad monitoring task for monitoring activity on the key pad 27. When a certain preset sequence of key strokes is received, referred to as the "locking sequence", this task sets the micro-controller to the interrupt or "locked" mode. When another preset sequence of key strokes is received, referred to as the "unlocking sequence", the key pad monitoring task sets the micro-controller to the operative or "unlocked" mode. The locking and unlocking sequences are only known to authorized persons. If an authorized person switches the device to the operative mode while the relay contacts 20 or 21 are in the open state due to a previous unauthorized attempt to use the appliance 11, the contacts 20 or 21 are closed by de-energizing relay 33 by eliminating the voltage from relay coil 34 through digital output line 37.

The key pad monitoring task supports additional key stroke sequences, in order to configure the micro-controller 26. This permits authorized persons to enter and alter the locking and unlocking sequences; to alter the current threshold at which power interrupt is engaged in the interrupt mode, to alter the "elapsed time threshold" which sets the time interval since the last authorized use following which the device will automatically enter the interrupt mode, and other system parameters as may be desired.

In addition, this task monitors whether the detachable key pad 27 is connected. When the key pad monitoring task determines that key pad 27 has been disconnected, the micro-controller 26 is automatically set to the interrupt mode.

(2) The second task is a current monitoring task which monitors the current drawn from the mains power supply by acquiring data on analog input channel 36. When this task determines that the current drawn from the mains power exceeds a preset limit, referred to as the "current threshold" if this occurs while the micro-controller is in the interrupt mode the current monitoring task will energize relay 33 by applying a voltage to the relay coil 34 through digital output line 37, thus opening relay contacts 20 or 21 and preventing transfer of supply power to the appliance 11. As noted above, when the micro-controller 26 is switched into the operative mode,this task de-energizes the relay 33 by eliminating the voltage from the relay coil 34 through digital output line 37. If the micro-controller 26 is in the operative mode, the current monitoring task monitors the electrical current drawn from the mains power supply while the microcontroller 26 remains in the operative mode, in order to determine when to notify the timing task (described below) that that electrical current has been reduced to below the current threshold, and when to notify timing task that the electrical current has exceeded the current threshold.

3) The third task is a timing task. When the micro-controller 26 is in operative mode, and the current monitoring task described above notifies the micro-controller 26 that the electrical current drawn from the mains power supply has just been reduced to below the current threshold, the timing task starts to count elapsed time. Similarly, when the micro-controller 26 is in the operative mode, and the timing task is in the process of counting elapsed time, and the current monitoring task notifies timing task that the current is once more exceeding the current threshold, then the timing task will stop counting elapsed time. When the micro-controller 26 is in the operative mode, and the elapsed time counted by the timing task reaches the "elapsed time threshold" referred to above, the micro-controller 26 will change to the interrupt mode. In addition, when the micro-controller 26 is in operative mode, the timing task implements a timer mode in which the length of time that current can be drawn in excess of the current threshold is limited to a preset time. After this preset time has elapsed, the timing task returns the micro-controller 26 to the interrupt mode, which will immediately cause the current monitoring task to interrupt the mains power supply as described above.

The operation of the device is as follows. When an authorized person uses the appliance 11, this person first enters the unlocking sequence into the keypad 27. The device is thus switched to the operative mode, and the appliance 11 is fully operational. When the authorized person has finished with the appliance 11, the device is switched to the interrupt mode in one of three ways: 1) the authorized person enters the locking sequence into the key pad 27; 2) the authorized person detaches the key pad 27 from the cord 41 by disconnecting plug 42 from the receptacle 43 in the keypad 27; or 3) the authorized person takes no action, in which case the timing task's timer will count time until it reaches the "elapsed time threshold".

When the appliance 11 is in the interrupt mode, auxiliary functions, such as a clock and/or light, remain operational, so long as their combined current draw is less than the "current threshold". When an unauthorized person attempts to use the heating functions of the appliance 11, which draw a comparatively greater current, the current threshold will be exceeded and the relay contacts 20 or 21 will be opened, disconnecting the mains power supply from the appliance while still supplying power to the micro-controller 26 through DC power supply 25.

It will be understood that the device in the interrupt mode does not actually cut off power to the appliance, i.e. interrupt the mains power supply, until the current threshold is exceeded by turning on a high current-drawing component of the appliance 11, such as a heating element.

Thus unauthorized attempts to use the appliance are immediately obvious from the fact that the auxiliary clock and light functions no longer operate. After an unauthorized use, an authorized person must connect the key pad 27—if it has been disconnected—and enter the unlocking sequence to once more supply mains power to the appliance to energize the anxiliary functions.

In addition, if the authorized user leaves the high current-drawing functions (for example, a heating element in a stove) on beyond a preset time, all electrical functions of the appliance 11, including auxiliary equipment, will automatically be deactivated after the preset time has elapsed unless the authorized user re-enters the unlocking sequence on the keypad 27 to restart the time elapsed timer. This feature will be of considerable comfort to persons who, after having left the premises, worry about whether or not they in fact turned the appliance off.

The invention having been thus described with reference to a preferred embodiment only, it will be appreciated by those skilled in the art that certain modifications and adaptations may be made without departing from the scope of the invention, as set out in the appended claims.

We claim:

1. For interrupting power to an electrical appliance having a first load which draws a current below a preset current threshold and a second load which draws a current above the preset current threshold, a device comprising means for connecting the device to an electrical power supply, means for supplying electrical power to the appliance connected to both the first load and the second load through a single switch, means for monitoring an electric current drawn by the appliance and comparing the electric current to the preset current threshold, the switch being controlled by means for selectively interrupting power to the appliance in an interrupt mode in which the device supplies power to the appliance to power the first load and when the second load is activated so that the current drawn by the appliance exceeds the current threshold the means for interrupting power opens the switch to thereby interrupt power to the appliance, the means for interrupting power to the appliance being responsive to entry of an authorization signal for switching the device from the interrupt mode to an operational mode in which the device supplies power to the appliance regardless of the current drawn by the appliance, and unlocking means for transmitting the authorization signal to the means for interrupting power to the appliance.

2. The device of claim 1 in which the unlocking means comprises an electronic keypad.

3. The device of claim 2 in which the keypad is detachable and the device automatically switches to the interrupt mode when the keypad is detached from the device.

4. The device of claim 1 in which the device automatically switches to the interrupt mode when a preset interval of time has elapsed since an authorization signal was transmitted to the means for interrupting power.

5. The device of claim 1 in which the means for switching the device between the interrupt mode and the operational mode includes a micro-controller.

6. The device of claim 1 in which the switch comprises a relay.

7. The device of claim 1 in which the means for monitoring an electric current includes a current transformer.

8. For interrupting power to an electrical appliance having a first load which draws a current below a preset current threshold and a second load which draws a current above the preset current threshold, a device comprising means for connecting the device to an electrical power supply, means for supplying electrical power to both the first load and the second load, switching means comprising a relay for closing an electrical connection between the means for connecting the device to an electrical power supply and the means for supplying electrical power, means including a current transformer for monitoring an electric current drawn by the appliance, means for comparing the electric current to the preset current threshold, means for switching the device between an interrupt mode and an operational mode responsive to entry of an authorization signal, and means including an electronic keypad for transmitting the authorization signal to the means for switching the device, whereby in the interrupt mode the device supplies power to the appliance to power the first load and when the second load is activated so that the current drawn by the appliance exceeds the current threshold the device interrupts power to the appliance.

9. The device of claim 8 in which the keypad is detachable and the device automatically switches to the interrupt mode when the keypad is detached from the device.

10. The device of claim 8 in which the device automatically switches to the interrupt mode when a preset interval of time has elapsed since an authorization signal was transmitted to the means for interrupting power.

11. The device of claim 8 in which the means for switching the device between an interrupt mode and an operational mode includes a micro-controller.

12. For interrupting power to an electrical appliance having a first load which draws a current below a preset current threshold and a second load which draws a current above the preset current threshold, a device comprising an electrical plug for connecting the device to an electrical power supply, an electrical receptacle for connection to a power cord of the appliance, for supplying electrical power to both the first load and the second load, a relay for closing an electrical connection between the power supply and the receptacle, a current transformer transmitting a signal to a micro-processor for monitoring an electric current drawn by the appliance, the micro-processor including means for comparing the electric current to the preset current threshold and means for for switching the device between an interrupt mode and an operational mode responsive to entry of an authorization signal, and an electronic keypad for transmitting the authorization signal to the micro-processor, whereby in the operational mode the device supplies power to the appliance to power both the first load and the second load, and in the interrupt mode the device supplies power to the appliance to power the first load and interrupts power to the appliance when the second load is activated so that the current drawn by the appliance exceeds the current threshold.

* * * * *